United States Patent [19]

Veber

[11] 4,415,413

[45] Nov. 15, 1983

[54] METHOD OF CONCENTRATING ALKALI METAL HYDROXIDE IN A CASCADE OF HYBRID CELLS

[75] Inventor: Andre Veber, Orge, France

[73] Assignee: Occidental Research Corporation, Irvine, Calif.

[21] Appl. No.: 310,903

[22] PCT Filed: Apr. 7, 1981

[86] PCT No.: PCT/US81/00446

§ 371 Date: Sep. 21, 1981

§ 102(e) Date: Sep. 21, 1981

[87] PCT Pub. No.: WO81/03035

PCT Pub. Date: Oct. 29, 1981

[30] Foreign Application Priority Data

Apr. 22, 1980 [FR] France ..... 80 09040

[51] Int. Cl.[3] ..... C25B 1/34

[52] U.S. Cl. ..... 204/98; 204/128; 204/DIG. 4; 429/17; 429/21; 429/34

[58] Field of Search ..... 204/98, 128, 129, DIG. 4; 429/17, 21, 34

[56] References Cited

U.S. PATENT DOCUMENTS 4,268,366 5/1981 Broniewski ..... 204/98

4,273,626 6/1981 Ezzel et al. ..... 204/98

*Primary Examiner*—R. L. Andrews

*Attorney, Agent, or Firm*—Walter Hackler

[57] ABSTRACT

Process for the simultaneous production of alkali metal hydroxide and electricl energy. A plurality of hybrid cells (1) are operated in series with an aqueous solution of alkali metal hydroxide introduced as anolyte into an anode compartment of a first hybrid cell (6) at one end of the series and an aqueous fluid medium receptive to alkali metal ions introduced as catholyte into a cathode of a last hybrid cell (7) at an opposite end of the series of cells (1). The anolyte is caused to flow through the anode compartments (3) of the cells (1) in sequence from the first cell (6) to the last cell (7) of the series of cells (1). The catholyte is caused to flow through the cathode compartments (4) in sequence from the last cell (7) to the first cell (6) countercurrently to the flow of anolyte from hybrid cell to hybrid cell of the series of cells (1).

16 Claims, 7 Drawing Figures

METHOD OF CONCENTRATING ALKALI METAL HYDROXIDE IN A CASCADE OF HYBRID CELLS

DESCRIPTION

BACKGROUND OF THE INVENTION

The present invention relates to electrochemical processes for production of chlorine and caustic from brine and to the simultaneous production of electrical energy. More particularly, the invention is directed to the treatment of cell liquor from a chloralkali cell to separate the sodium ions from the cell liquor and concentrate them in another liquor as a sodium hydroxide solution.

The production of chlorine and crude caustic solutions by electrolysis of brine is a major industry. Two types of electrolysis cells are primarly used in the production of chlorine and caustic. They are the diaphragm cell and the mercury cell. Membrane cells are also used to a minor but growing extent. Considerable quantities of energy are required for electrolysis of the brine to produce chlorine and subsequent treatment of the cell liquor resulting from electrolysis in diaphragm cells is necessary to obtain caustic solutions of the desired purity and concentration. A 50 weight percent aqueous caustic solution of low sodium chloride content is a commercially desired product.

Known processes for electrolysis of brine in diaphragm mercury and membrane cells produce cathode cell liquors having a caustic content of about 10 to as high as about 40 percent by weight in membrane cells and 50 percent by weight in mercury cells. Sodium chloride content of the liquor is up to about 15 percent by weight for diaphragm cells, virtually absent in the liquor of membrane cells and essentially absent in the liquor of mercury cells. Mercury cells have environmental problems and are no longer the technology of choice in industrialized countries. The cathode cell liquor produced by a diaphragm cell typically contains about 10 to 12 percent by weight caustic (NaOH) and 15 percent by weight sodium chloride (NaCl).

In the diaphragm cell, brine is continuously fed to an anode compartment, where chlorine is produced, and then flows through a diaphragm, usually made of asbestos, to a cathode compartment. Hydrogen gas is discharged from the solution at the cathode, with attendant generation of hydroxyl ions. To minimize backmigration of hydroxide ions from the cathode compartment to the anode compartment, a positive flow rate is always maintained; that is, a flow in excess of the conversion rate. As a consequence, the resulting catholyte solution, i.e., the cathode cell liquor as the term is used herein, has unconsumed sodium chloride in addition to product sodium hydroxide. The cathode cell liquor containing the sodium hydroxide and sodium chloride must be purified and must be concentrated to obtain a salable caustic solution.

A membrane cell, which employs a membrane selectively permeable to certain cations in place of a diaphragm, yields a catholyte of low salt content and having a caustic content of up to about 40 percent by weight. The highly corrosive chlorine medium, however, is harsh on membrane materials. Accordingly, specifications for the membrane must be rigid and the membranes useful in the presence of chlorine are quite expensive. In addition, voltage drop within the membrane cell is relatively high which increases consumption of electricity. In sum, membrane cells are costly in regard to investment and operating costs.

Typical processes for concentrating cell liquor and separating the sodium chloride from the caustic involve evaporation and crystallization with the consumption of large amounts of steam and, consequently, fuel required to generate steam. Investment in such processes is considerable.

The hybrid cell, described in greater detail herein, is an electrochemical generator of the fuel cell type consuming hydrogen at the anode and oxygen at the cathode. It includes an additional integrated electrodialysis function. The electrolytic space is separated into two sub-spaces by a diffusion barrier, with the anolyte on one side and the catholyte on the other. These electrolytes pass through the cell parallel to the plane of the diffusion barrier. The function of a hybrid cell is the supply of electrical energy and the exhaustion of a chemical species contained in the anolyte as well as the accompanying enrichment of the catholyte with the same chemical species. Typically, the anolyte is a 10% NaOH and 15% NaCl solution coming from a chloralkali cell to be exhausted to 0.5% or less NaOH, and the catholyte is a 0 to 10% NaOH solution at inlet and is enriched to 40% or more NaOH at the outlet.

Several hybrid cells electrically in series or supplied electrolytically in parallel, may have associated with them various circulation modes for the anolyte and catholyte, namely, ascending cocurrent, descending cocurrent, and countercurrent. All of these circulation modes have drawbacks.

The significant variation in the anolyte concentration (for example, from 10% to 0.1% NaOH) requires the entire anode to work at the lowest potential corresponding to the part of the solution most diluted with respect to the chemical species to be exhausted. The hydroxide concentration is smallest in the terminal passage region of the anode compartment and tends to establish the potential of the entire anode. As a consequence polarization of the anode is increased and voltage efficiency of cell is reduced.

As concentration gradients increase across the diffusion barrier, chemical driving forces may promote back-diffusion of the caustic product from a high-strength catholyte to the lower-strength anolyte, which reduces the concentration of alkali metal hydroxide in the produce and the overall efficiency of the process.

Many commercially available cation permselective diffusion barriers exhibit a permselectivity which decreases as the difference in concentration on each side of the diffusion barrier increases.

The above-mentioned phenomena may be minimized by countercurrent circulation of anolyte and catholyte. In contrast, cocurrent circulation would aggravate these undesirable effects. However, countercurrent circulation has its disadvantages. The exhustion of the anolyte and the enrichment of the catholyte require a slow electrolyte circulation rate requiring a high degree of control of the flow with plug flow being preferred to prevent back mixing and disruption of the concentration gradient. Cocurrent circulation best maintains a condition of plug flow through the cell compartments. Countercurrent flow, by contrast, leads to the construction of a hybrid cell with components having very close tolerances, and hence of high cost. Moreover, cocurrent flow minimizes the difference in pressure on each side of the diffusion barrier compared with countercurrent and consequently reduces any cross-diffusion related to membrane imperfections, such as holes, for example. Countercurrent flow would aggravate the problems of cross-diffusion.

The above-mentioned drawbacks of the cocurrent and countercurrent circulation modes are minimized by the use of the cascade of this invention, which is described more fully herein.

SUMMARY OF THE INVENTION

In accordance with the present invention, there is provided a process for the simultaneous production of alkali metal hydroxide and the generation of electrical energy using a cascade of hybrid cells. The invention minimizes the disadvantages, and combines the advantages, of the cocurrent and countercurrent circulation modes. The invention is preferably directed to forming a purified and concentrated caustic solution from the effluent of a chloralkali cell with attendant generation of electrical energy for use by the chloralkali cell.

In the process of the invention, a plurality of hybrid cells are operated in series. The plurality, or cascade, includes a first hybrid cell and a last hybrid cell of the series. Each hybrid cell is of the two- or three-compartment type. The two-compartment cell is preferred and comprises a gas diffusion type anode, a gas diffusion type cathode, and a diffusion barrier selectively permeable to cations. The anode, the cathode, and the diffusion barrier each have first and second surfaces. The first surface of the anode and the first surface of the diffusion barrier form an anode compartment, and the first surface of the cathode and the second surface of the diffusion barrier form a cathode compartment.

The process comprises introducing flow of an aqueous solution of at least one alkali metal hydroxide as anolyte to the anode compartment of the first hybrid cell at one end of the series. Flow of an aqueous fluid medium receptive to alkali metal ions is introduced as catholyte to the cathode compartment of the last hybrid cell at the opposite end of the series. The anolyte is caused to flow through the anode compartments in sequence from the first cell to the last cell of the series. The catholyte is caused to flow through the cathode compartments in sequence from the last cell to the first cell countercurrently to the flow of anolyte from hybrid cell to hybrid cell of the series. However, the catholyte flow is cocurrent with respect to anolyte flow through each individual hybrid cell.

In each cell, a flow of current from the cathode through an external load to the anode is generated by oxidation of hydrogen supplied to the second surface of the anode and by generation of hydroxide ions by reduction of an oxygen-containing gas supplied to the second surface of the cathode. Under conditions of current flow, some alkali metal ions selectively pass from the anolyte, through the diffusion barrier, and to the catholyte. The metal ions form, with cathode generated hydroxide ions, an aqueous solution of alkali metal hydroxide. Each hybrid cell is operated under conditions which are effective for removing only a fraction of the alkali metal from the anolyte and concentrating it in the catholyte.

The catholyte, which is more concentrated in respect to alkali metal hydroxide and the aqueous fluid medium introduced to the cathode compartment of the last hybrid cell of the series, is withdrawn from the cathode compartment of the first hybrid cell. The anolyte, which is more depleted in respect to alkali metal hydroxide than the aqueous solution introduced to the anode compartment of the first hybrid cell of the series, is withdrawn from the anode compartment to the last hybrid cell.

The cascade can also be operated with hybrid cells having three compartments. By incorporating a diaphragm, permeable to both cations and anions and having first and second surfaces into the cathode compartment in a position between the diffusion barrier and the cathode, a hybrid cell having three compartments results. In such a cell, the anode compartment is defined by a first surface of the gas diffusion type anode and a first surface of the diffusion barrier. A central compartment is defined by a second surface of a diffusion barrier and the first surface of the diaphragm. The cathode compartment is defined by a second surface of the diaphragm and the first surface of the gas diffusion type cathode. The anode, central, and cathode compartment each have an inlet and an outlet, with the outlet at the central compartment being in flow communication with the inlet of the cathode compartment. With a three-compartment cell, catholyte is introduced into the inlet of the central compartment and withdrawn from the outlet of the cathode compartment. The catholyte flows through both the central and cathode compartments before passing to the next stage of the cascade. The cascade may include a bypass connecting a cathode compartment outlet with the initial cathode compartment inlet to improve when required the conductivity of the catholyte by addition of some of the produced alkali metal hydroxide to the cathode feed.

BRIEF DESCRIPTION OF THE DRAWINGS

The invention may be more clearly understood by reference to the drawings, wherein.

DETAILED DESCRIPTION

Alkali metal hydroxide solutions, especially solutions containing alkali metal halides, can be treated in accordance with this invention. For convenience of explanation, the feed solution typically has an alkali metal concentration between about 5 and 30 weight percent, calculated as the alkali metal hydroxide. Preferably, the solution is a chloralkali cell liquor, having a sodium hydroxide concentration of up to about 28 percent preferably between about 10 and 25 weight percent and up to about 26 weight percent sodium chloride preferably 15 weight percent sodium chloride. Solutions of other alkali metal hydroxides, such as potassium hydroxide and lithium hydroxide, can also be treated. The cell liquor can also contain other alkali metal salts, such as sodium bromide, potassium iodide, and the like. The invention is adaptive to treating liquors from chloralkali cells, including diaphragm cells, membrane cells, and the like. Methods of operating such cells and the nature of the cell liquor produced in their operation are well known to those skilled in the art and have been described in an extensive body of technical publications and patents. Accordingly, the ensuing description will be directed primarily to the operation of the hybrid cells in a cascade and in combination with chloralkali cells.

Figure 1:
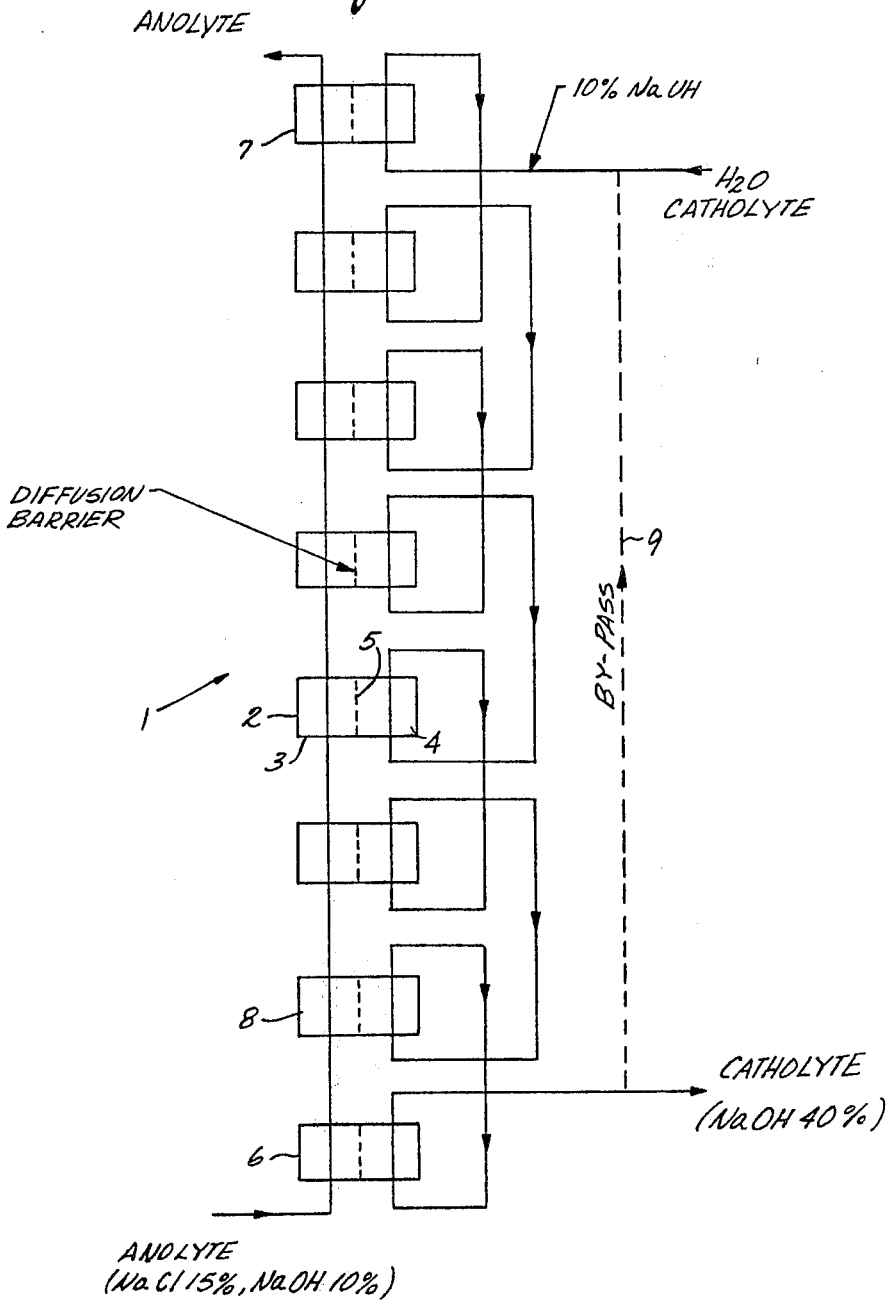
FIG. 1 is a schematic illustration of a cascade of individual hybrid cells showing the sequence and arrangement of the cells in the cascade, according to this invention.

FIG. 1 schematically depicts the operation of a hybrid cell cascade of this invention. A cascade 1 comprises a plurality of hybrid cells 2 arranged in hydrodynamic series. Each hybrid cell 2 has an anode compartment 3 and a cathode compartment 4 separated by a diffusion barrier 5. There is a first hybrid cell 6 and a last hybrid cell 7 of the series.

In the operation of an individual hybrid cell, an aqueous solution of alkali metal hydroxide passes through the anode compartment and is continuously depleted of hydroxide ions, and alkali metal ions for ionic neutrality, resulting in an alkali metal ion and hydroxide concentration gradient between the inlet and outlet of the anode compartment. As a consequence of acceptance of alkali metal ions by an aqueous media passing through the cathode compartment and, in the three-compartment cells, through the central compartment as well, and generation of hydroxide ions by reduction of oxygen, the aqueous media becomes more concentrated in alkali metal hydroxide as it progresses through the cathode compartment and if used, the central compartment. The catholyte leaves the cathode compartment as a solution more concentrated in alkali metal hydroxide than the aqueous media introduced to the cathode or central compartment. A more detailed description of the individual hybrid cells, and their operation above and with chloralkali cells, is herein provided in connection with FIGS. 2–7.

The operation of the cascade commences when flow of an aqueous solution of at least one alkali metal hydroxide is introduced as anolyte to the anode compartment of the first hybrid cell 6 at one end of the cascade series. Preferably, the anolyte comprises cell liquor from a chloralkali cell. The anolyte flows through the anode compartment and is partially depleted of alkali metal hydroxide. The effluent from the anode compartment is withdrawn from cell 6 and is introduced as anolyte into the anode compartment of a second hybrid cell 8. The anolyte passes through the remainder of the cascade in this manner and is partially depleted of alkali metal hydroxide during each stage. The effluent withdrawn from the anode compartment of the last cell 7 at the other end of the cascade is substantially depleted of alkali metal hydroxide.

The catholyte also flows through the series of hybrid cells. As depicted in FIG. 1, the anolyte and the catholyte enter at opposite ends of the cascade. The catholyte enters the cascade in cell 7 at one end and progresses through the cascade to cell 6 at the other end. As catholyte flows through the individual cathode compartments in succession it is progressively partially enriched in alkali metal hydroxide. In accordance with the invention herein, and with respect to flow from hybrid cell to hybrid cell of the series, the catholyte flows countercurrently to the flow of anolyte. However, with respect to flow through each individual hybrid cell of the series, the catholyte flow is cocurrent with respect to the anolyte.

Each hybrid cell is operated under conditions which are effective for removing only a fraction of the alkali metal from the anolyte and concentrating it in the catholyte. The fraction may be determined by the number of cells operated in the cascade. For example, in a cascade comprising n stages, exhaustion in each stage is about one nth of the exhaustion desired for the anolyte flowing through the cascade.

In using the cascade as depicted, each individual anode may be operated at a small anolyte concentration gradient between the inlet and outlet of the anode compartment. As a consequence voltage efficiency of the individual cells, and of the cascade as a whole, may be increased to its practical maximum using gas diffusion anodes commercially available. For hybrid cell cascades using these anodes, the greater the number of stages, the smaller the concentration gradient of alkali metal hydroxide in each stage, and the higher the voltage efficiency of the inndividual cells.

Any number of stages can be employed in the cascade. There is no upper limit, except for economies of cost and size required by the user. In the presently preferred embodiments, there are eight to ten stages.

The countercurrent system circulation causes the anolyte and the catholyte to have the smallest possible average difference in concentration of caustic metal hydroxide on each side of the individual diffusion barriers. The anolyte and the catholyte enter at opposite ends of the cascade. Cell 7, at one end and the cascade, serves both as the final stage for the anolyte and the initial stage for the catholyte. The concentrations of sodium hydroxide in this cell are at their minimum values, e.g., anolyte at about 0.5% or less sodium hydroxide, catholyte at about 0 to 10% sodium hydroxide. In cell 6, at the opposite end of the cascade, which serves as the initial stage for the anolyte and as the final stage for the catholyte, sodium hydroxide concentrations are maximized: anolyte at about 10% NaOH, catholyte up to about 40% NaOH. Within the cascade of FIG. 1, as compared to a different cascade, where both the anolyte and the catholyte would enter the cascade in the same stage, there is the least possible average difference in caustic concentration across the diffusion barriers.

As discussed, when concentration gradients increase across the diffusion barrier, chemical driving forces are thought to promote back-diffusion of the caustic product from a high-strength catholyte to the lower-strength anolyte, which reduces the concentration of sodium hydroxide in the product and the overall efficiency of the process. Also, many commercially available diffusion barriers, such as ion exchange membranes exhibit a decrease in permselectivity at concentration differences across the membrane above about 30% by weight caustic which affects efficiency. The countercurrent circulation from hybrid cell to hybrid cell of the series is employed to increase efficiency and product purity by minimizing the average concentration differential of sodium hydroxide in any one hybrid cell.

As indicated, the cascade may be considered, as a whole, to operate generally in countercurrent flow with variations in electrolyte concentration being small in any given hybrid cell of the series. However, inside each hybrid cell, the circulation of catholyte is cocurrent to the anolyte circulation. Cocurrent circulation facilitates a condition of plug flow in the compartments and minimizes any cross-diffusion of caustic as may be caused by membrane imperfections. Moreover, cocurrent circulation limits any differences in pressure on each side of the diffusion barrier that may arise in operation.

The cascade may be operated with either ascending or descending electrolytes in the individual hybrid cells.

A bypass 9, shown in FIG. 1, may be included to provide communication of enriched catholyte from the last catholyte stage 6 of the cascade to the initial catholyte cell 7. When employed it is used to add small amounts of product sodium hydroxide to the catholyte entering the cascade, which may be pure water, to increase its conductivity. Generally the amount of caustic added is sufficient to provide a feed catholyte containing about 0 to about 25 percent by weight NaOH preferably from about 10 to about 15 percent by weight. This increases conductivity in the feed which may be pure water.

The cascade may be operated with either two-compartment hybrid cells or three-compartment hybrid cells. When a three-compartment hybrid cell is employed in the cascade, the catholyte enters the three-compartment cell in a central compartment and passes from the central compartment to the cell cathode compartment. The catholyte passes through the cathode compartment and is withdrawn from the three-compartment cell to be introduced to the next stage of the cascade. In sum, the catholyte is caused to flow sequentially through the central and cathode compartments of a cell before passing to the next cell.

The operation of the cascade has been described with reference to two- and three-compartment hybrid cells. The structure and operation of the individual hybrid cells is hereby described in greater detail.

Figure 2:
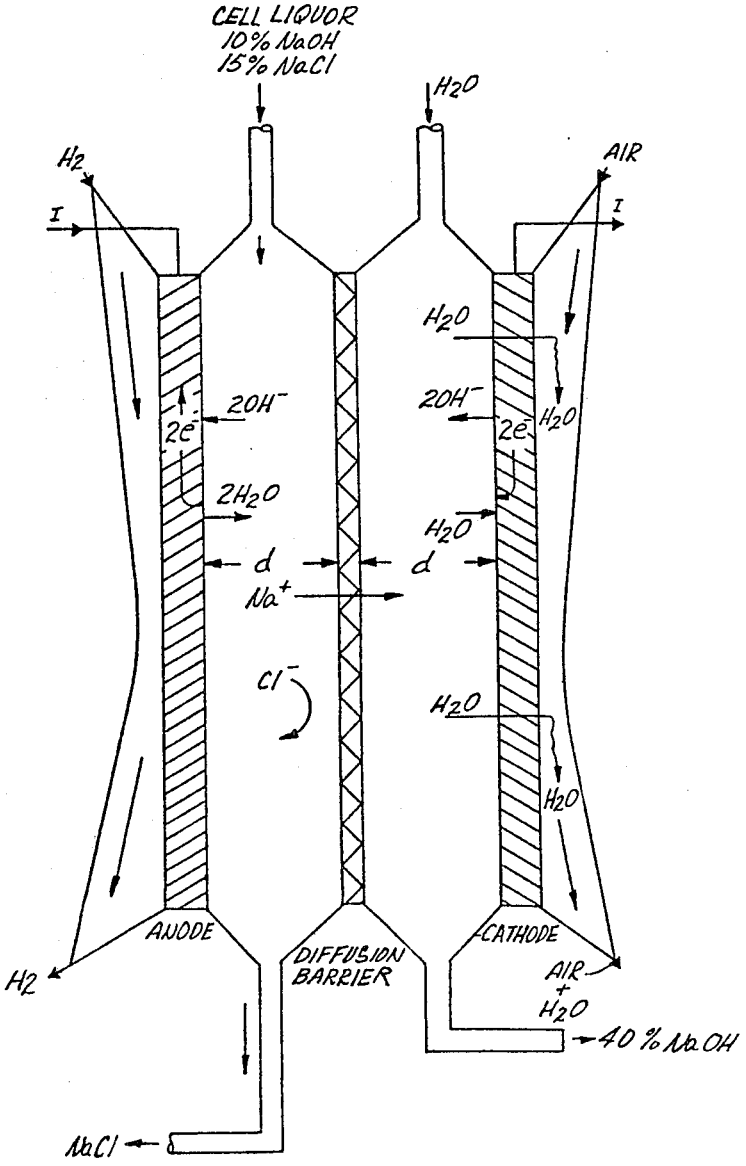
FIG. 2 is a schematic illustration of a two-compartment hybrid cell used in practice of this invention.

FIG. 2 schematically depicts the operation of a two-compartment hybrid cell. A chloralkali cell liquor, containing about 12 weight percent NaOH and about 15 weight percent NaCl is introduced, as anolyte, into the anode compartment of the hybrid cell. The anode and cathode compartments of the cell are designed so that flow of the anolyte and catholyte is substantially in one direction from inlet to outlet without appreciable mixing, back-convection, or diffusion parallel to the electrodes of molecules and ions in each compartment, and so that cation flow is substantially transverse to the flow of the anolyte. Preferably a condition of plug flow is maintained. This is more easily achieved when the average distance (d) between anode and diffusion barrier and diffusion barrier and cathode are respectively about 1 mm or less, typically about 0.1 mm to about 1 mm.

The cell liquor contacts a gas diffusion type anode. Hydrogen gas from any source, and preferably from a chloralkali cell, contacts the opposite side of the anode. The anode provides a surface for intimate contact between the hydrogen gas and the anolyte.

Hydrogen gas undergoes an oxidation reaction with the anolyte hydroxide ion at the anode which may be schematically represented as:

$$H_2+2OH^-\rightarrow 2H_2O+2e^-$$

As the anolyte flow through the anode compartment, its hydroxide ion content is progressively reduced and its water content progressively increased.

Figure 5:
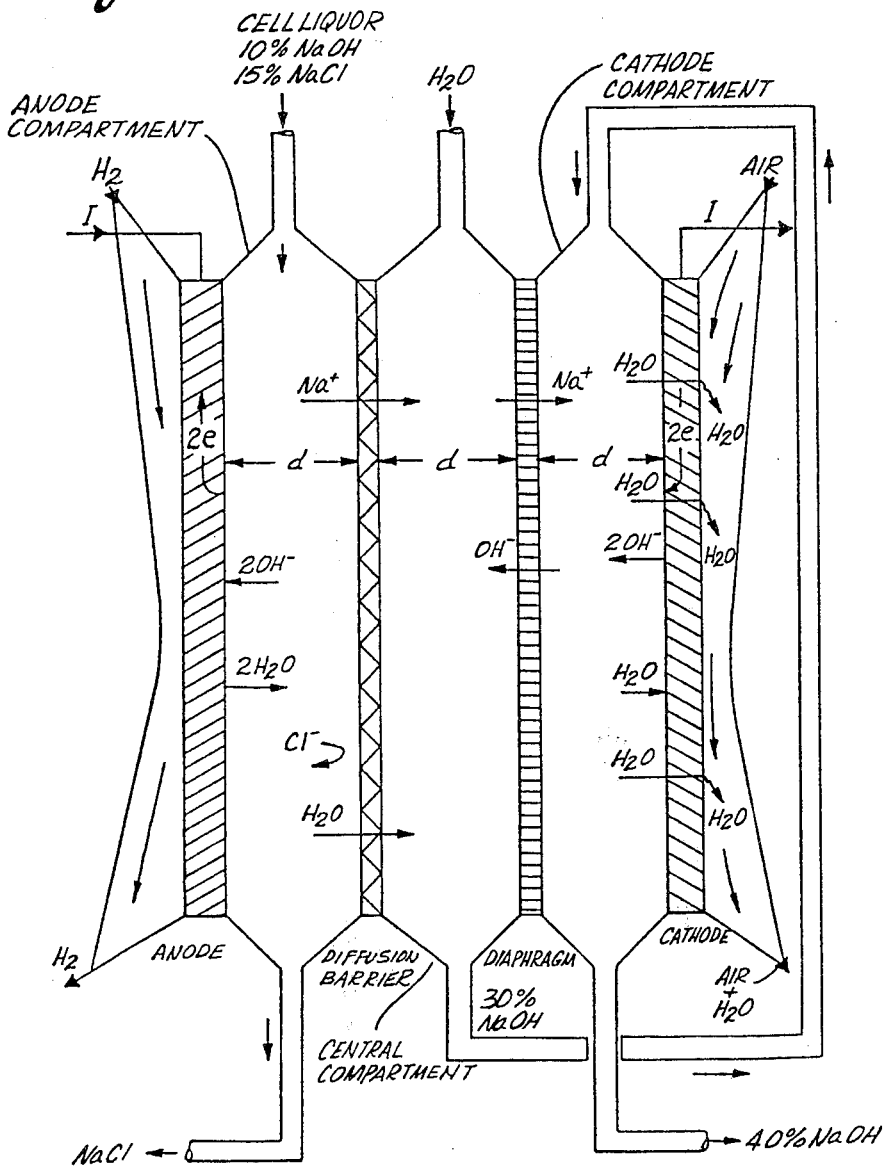
FIG. 5 is a schematic illustration of a three-compartment hybrid cell used in practice of this invention.

FIG. 5 schematically depicts the operation of a three-compartment hybrid cell which may be used in the cascade of this invention. The anode, anode compartment, and anolyte used in the three-compartment hybrid cell of FIG. 5, and the operation thereof, are substantially the same as in the two-compartment hybrid cell of FIG. 2.

The cathode compartment of the two-compartment hybrid cell of FIG. 2, and the central compartment of the three-compartment hybrid cell of FIG. 5, are separated from the relevant anode compartment by the above-mentioned cation-permselective diffusion barrier such as a membrane. This is a barrier which is permeable to cations such as a sodium ion, but is relatively impermeable to anions such as the chloride ions. To maintain electroneutrality and to account for depletion of hydroxide ions from the anolyte, sodium ions, under condition of current flow through an external load, separate from the anolyte and pass through the cation-permselective barrier into a catholyte passing through the cathode compartment of the hybrid cell of FIG. 2, or the central compartment of the hybrid cell of FIG. 5. Substantially all of the chloride ions remain in the anolyte, along with sufficient sodium ions to electrically balance the chloride ions. The central compartment of the three-compartment cell is separated from the cathode by a barrier which is permeable both to anions and cations, such as a semipermeable asbestos diaphragm.

In the two-compartment hybrid cell of FIG. 2, an aqueous medium such as water or a dilute ionic solution, which may be part of the solution drawn from the anode compartment, is introduced as catholyte into the cathode compartment and progressively picks up sodium ions moving through the cation-permselective membrane. The catholyte contacts one surface of a gas diffusion type cathode where oxygen gas, preferably from air, undergoes a reduction reaction with the catholyte water which may be schematically represented as follows:

$$H_2O+\tfrac{1}{2}O_2+2e^-\rightarrow 2OH^-$$

The generated hydroxide ions balance the sodium ions which enter the catholyte to form a caustic solution having increased caustic concentration in the direction of flow of the catholyte. Concentration is due in part to consumption of water at the cathode.

In the three-compartment hybrid cell of FIG. 5, the aqueous medium such as water or a dilute ionic solution, is first introduced into the central compartment, and progressively picks up sodium ions moving through the cation-permselective membrane. The reaction at the cathode is the same as in the two-compartment hybrid cell. Some of the hydroxide ions pass from the cathode compartment to the central compartment. The net effect is that the sodium hydroxide content of the catholyte also increases as it flows through the central compartment.

A catholyte, now of intermediate sodium hydroxide concentration, is withdrawn from the central compartment and introduced into the cathode compartment of the three-compartment hybrid cell. A proportion of the sodium ions entering the central compartment through the cation-permselective membrane continues on through the ion-permeable barrier or diaphragm into the cathode compartment. When sodium hydroxide solution from the central compartment is introduced into the cathode compartment, the sodium ions which pass through the ion permeable barrier accumulate in the catholyte contacting the gas diffusion type cathode. Oxygen from the air is reduced, forming hydroxide ions to balance the sodium ions and consume water of the catholyte; thus partially concentrating the sodium hydroxide solution.

In the operation of either the two-compartment or the three-compartment hybrid cell, concentration of the alkali metal hydroxide in the receptive aqueous media occurs as a consequence of cation transfer, electrolytic consumption of water with reduction of oxygen at the cathode to form hydroxide ions, and evaporation of water from the catholyte at the opposite surface of the cathode into the air stream. For a given cathode surface area and permeability, the flow of air may be regulated to control evaporation of water from the surface of the cathode to modify the concentration of sodium hydroxide in the catholyte. In practice, the rate of addition of water to either the cathode or the central compartment, the rate of transport of water through the cation-permselective barrier into the catholyte, the rate of consumption of water at the cathode and the rate of evaporation of water from the cathode, are all correlated so as to provide a product catholyte of desired caustic concentration.

Thus, when the cell liquor, the water and the catholyte introduced to the two- or three-compartment hybrid cell all flow through their respective compartments, as shown in FIG. 2, FIG. 5, and in the pattern shown in FIG. 1, the sodium hydroxide concentration of the relevant anolyte decreases from about 10% by weight at the appropriate inlet and approaches 0% at the outlet. The sodium hydroxide concentration of the relevant catholyte, by contrast, increases from about 0% at the appropriate inlet to about 40% or more at the outlet. High concentration gradients are achievable with currently available membranes and diaphragms; however, as discussed, the countercurrent system circulation of the cascade of FIG. 1 minimizes these average concentration gradients and improves the efficiency of the purification and concentration process.

As indicated, the anolyte withdrawn from the anode compartment is substantially depleted of sodium hydroxide. However, even when the effluent from the anode compartment contains as little as 0.1 weight percent or 0.01 weight percent of sodium hydroxide, the pH of the effluent is high, i.e., above 12. The high pH of the effluent from the anode compartment is advantageous in that polarization and loss of current efficiency which can be associated with a change from an alkaline to a neutral or acid pH within the cell is minimized.

The process and hybrid cells illustrated in FIG. 2 or FIG. 5 can, of course, be used to treat cell liquors having differing concentrations of alkali metal hydroxide and alkali metal halide. By regulating the flow of water or dilute aqueous alkali hydroxide into the cathode compartment of FIG. 2, or into the central compartment of FIG. 5, and by the evaporation of water from the porous cathode, the concentration of the product flowing from the cathode compartment can be varied over a wide range. Thus, a range of concentrations of product alkali metal hydroxide can be achieved at will.

Figure 3:
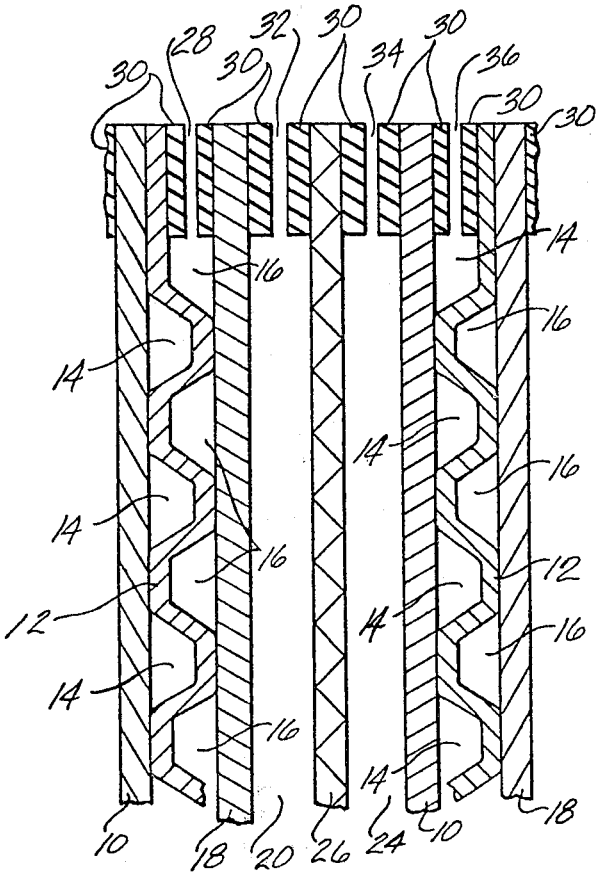
FIG. 3 is a partial cross-sectional view of a hybrid cell having a plurality of thin cell units.
Figure 6:
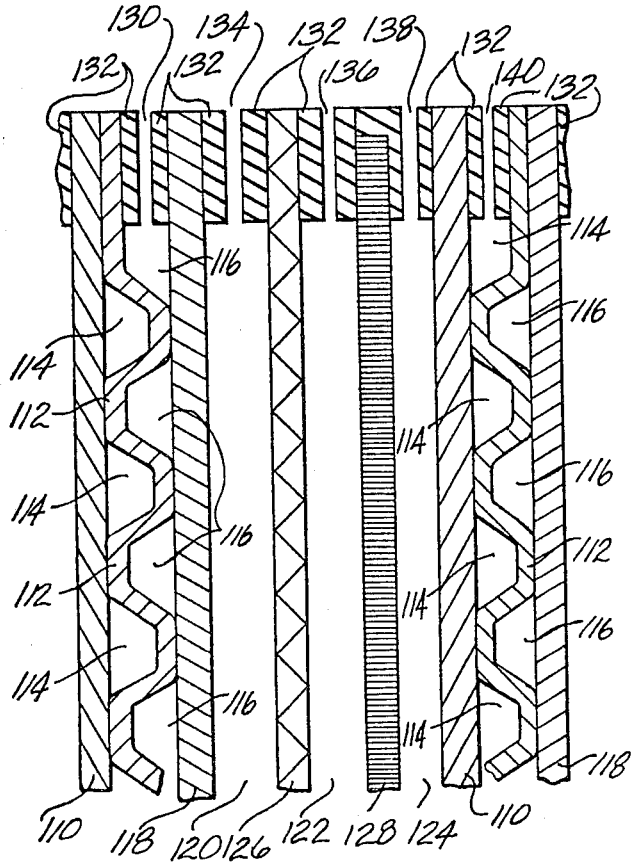
FIG. 6 is a partial cross-sectional view of a three-compartment hybrid cell having a plurality of thin cell units.

As shown in FIGS. 3 and 6, hybrid cells can be arranged in a filter press type structure with a multitude of elementary hybrid cells connected in series forming a net hybrid cell.

FIG. 3 is a partial cross-sectional view of a portion of a filter press type two-compartment hybrid cell unit showing the sequence and arrangement of elements in the cell. There are provided gas diffusion type cathodes 10 and electrically conductive gas separator and current collectors 12 which help to define air channels 14 and hydrogen channels 16; gas diffusion type anodes 18; an anolyte compartment 20; a catholyte compartment 24 and membrane 26. The following conduits are formed by insulating ported spacers 30; conduit 28 serves hydrogen channels 16; conduit 32 is for the anolyte liquor to be processed; conduit 34 is for the aqueous catholyte media and conduit 36 is for the air fed to channels 14.

FIG. 6 is a partial cross-sectional view of a portion of a filter press type three-compartment hybrid cell unit showing the sequence and arrangement of elements in the cell. There are provided gas diffusion type cathodes 110 and electrically conductive gas separator and current collectors 112 which help to define air channels 114 and hydrogen channels 116; gas diffusion type anodes 118; an anolyte compartment 120; central compartment 122; catholyte compartment 124; membrane 126 and diaphragm 128. The following conduits are formed by insulating ported spaces 132: Conduit 130 which serves hydrogen channels 116; conduit 134 which is for the liquor to be processed; conduit 136 for water; conduit 138 for fluid flow to cathode compartment 124; while conduit 140 is for feed of air to channels 114.

Given the sequence of elements, such variables as the thickness and spacing of elements, the shape of the air and hydrogen channels are subject to wide variation. In addition, many different materials of construction may be employed because the process of this invention is practiced under relatively mild conditions, particularly when compared with the highly oxidative and corrosive conditions found in a chloralkali cell. Thus, any material stable to alkali hydroxide and cell operating temperature may be used.

Materials of construction and cell construction arrangements are described, for instance, in U.S. Pat. Nos. 3,098,762; 3,196,048; 3,296,025; 3,511,712; 3,516,866; 3,530,003; 3,764,391; 3,899,403; 3,901,731; 3,957,535; 4,036,717 and 4,051,002 and British Pat. Nos. 1,211,593 and 1,212,387, each incorporated herein by reference.

The cation permselective membranes may be perfluorosulfonic acid polymers manufactured by du Pont under the trade Name Nafion and perfluorocarboxylic acid polymers manufactured by Asahi Chemical Co. Other low cost membranes prepared from sulfonated polymers, carboxylated hydrocarbons polymers, phenolics resins, polyolefins and the like, may also be used.

Whatever the selected material, the membrane should preferably have a permselectivity in 40% NaOH of at least about 0.95, an ohmic resistance not more than about 3 ohm-cm and an electrosmotic coefficient of not more than about 74 gms of water per Faraday.

The gas diffusion anodes and cathodes conventionally employed in the fuel cell art may be used in the construction of the hybrid cells and are semihydrophobic. They generally consist of a gas diffusion layer which may be catalytic per se or have catalytic properties induced or promoted by a noble metal and the like. A suitable gas diffusion type cathode and/or anode may be formed of activated carbon which may be catalyzed by a noble metal and combined with a support material such as Teflon ™.

The porous diaphragms can be made of fuel cell grade asbestos films, porous rubber battery separators, or ion exchange membranes which are permeable to both anions and cations.

For the three-compartment type of hybrid cells, it is contemplated that the catholyte can be transferred from a central compartment of the hybrid cell to the cathode compartment in either or both of two ways. First, the catholyte can be withdrawn from an outlet of the central compartment and introduced into an inlet of the cathode compartment. Second, by establishing a pressure differential across a porous diaphragm, the catholyte from the central compartment can be made to flow through the diaphragm into the cathode compartment. Both means of transferring catholyte from the central compartment to the cathode compartment can be employed simultaneously. Liquid permeable polymeric films and woven or non-woven fabrics may also be used as materials of construction for the porous diaphragm.

The hybrid cells can be operated at any temperature which maintains the electrolytes in a liquid state and avoids the precipitation of dissolved constituents such as alkali metal halide or alkali metal hydroxide. Temperatures of from about 20° C. to 100° C., more preferably 40° C. to 70° C., may be employed. Because the cell liquor from a chloralkali cell is warm and because heat is generated within the fuel cell during its operation, it is necessary to cool the cell to maintain a desired operating temperature. The cell is conveniently cooled as an incidence of evaporation of water from the catholyte through the gas diffusion type cathode into the stream of air which is passed across the surface of the cathode opposite to the surface in contact with the catholyte to supply oxygen to the cathode. In a filter press type of construction, the individual cells are so thin than there is excellent heat transfer between the anode, cathode, and fluid compartments.

To achieve effective cooling through the cathode by evaporation, it may be desirable to continuously introduce fresh, dry air into the hybrid cell at a point removed from the air intake which supplies the hybrid cell. Air can be dried conveniently by passing it over cooling coils or through desiccant such as silica gel in accordance with known methods.

Air is the lowest cost source of oxygen required for the cathode and serves to carry off evaporated water. Other oxygen-containing gases as well as oxygen enriched air can also be used but at greater expense.

Figure 4:
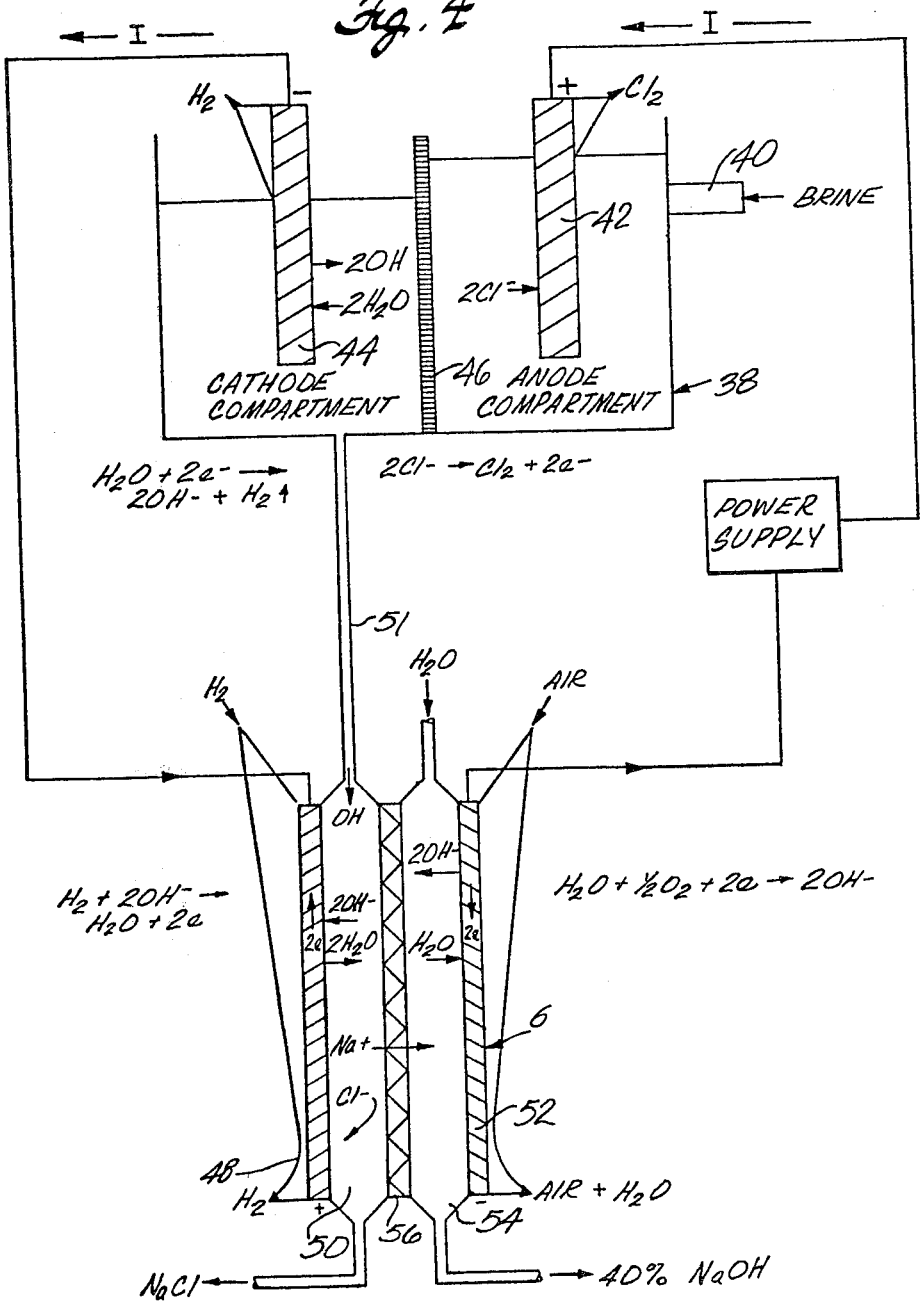
FIG. 4 is a flow diagram showing a chloralkali cell and a hybrid cell being operated in combination.
Figure 7:
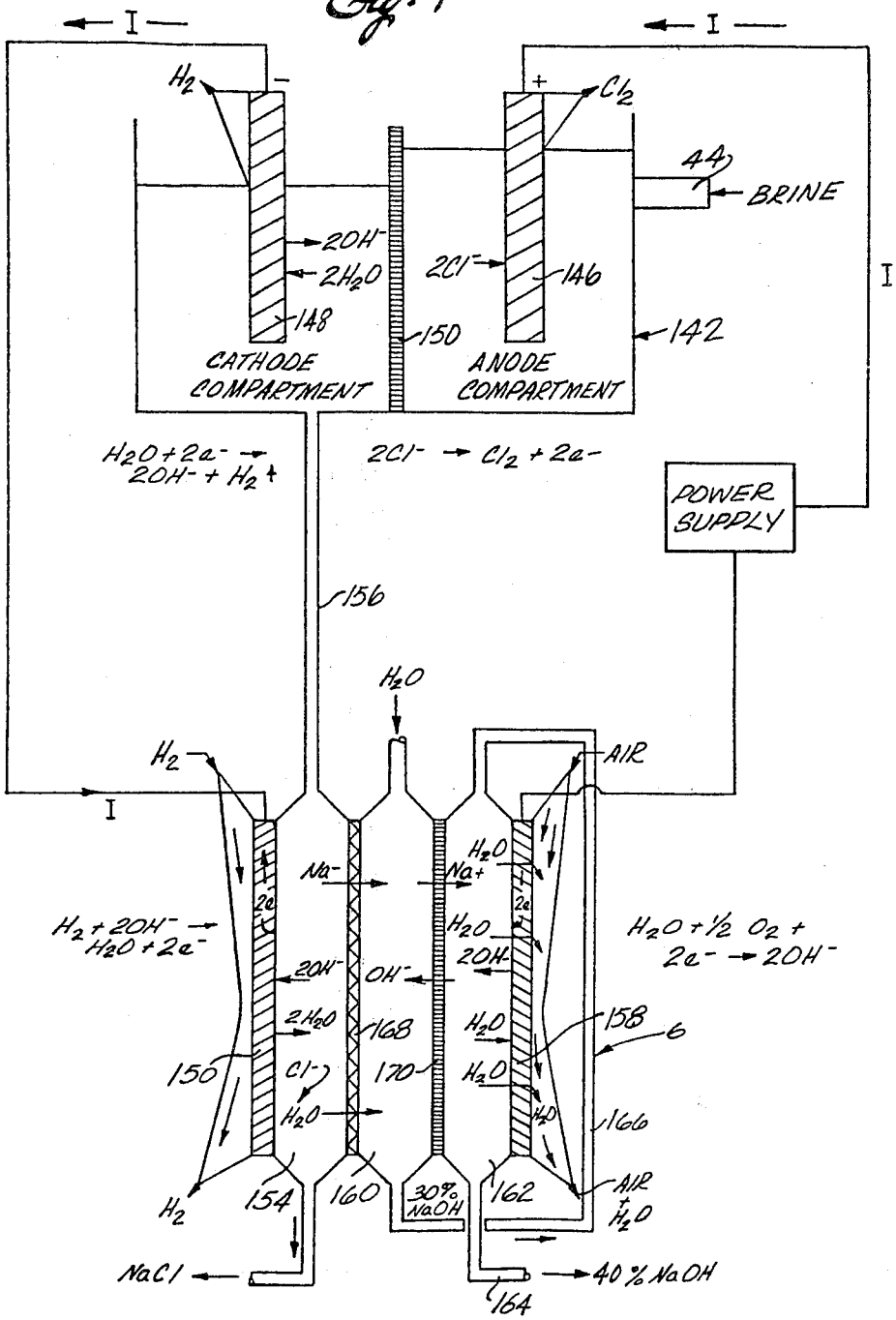
FIG. 7 is a flow diagram showing a chloralkali cell and a three-compartment hybrid cell being operated in combination.

Although the electrical energy generated as a consequence of the electrochemical oxidation and reduction reactions which occur in the hybrid cell may be fed to any load, it is advantageous to couple a cascade of hybrid cells as depicted in FIG. 1 with a chloralkali cell to provide part of the electrical energy required to operate the chloralkali cell, as shown in FIGS. 4 and 7 wherein the coupled hybrid cell is the first cell of 6 of the cascade. Brine is introduced to the chloralkali cell 38 by line 40. Chlorine is generated at anode 42 and hydrogen released at cathode 44. Diaphragm 46 separates the compartments. Hydrogen generated in the chloralkali cells is supplied to gas diffusion anodes 48 of the hybrid cells of the cascade and cell liquor to anode compartment 50 of the first cell 6 of the cascade by line 51. Air is supplied to the gas diffusion cathode 52 and water to cathode compartment 54. Current flow is induced by reduction of oxygen at the cathode and oxidation of hydrogen at the anode. During current flow, sodium ions introduced to the hybrid cell from the chloralkali cell liquor pass transverse to the flow of the anolyte chloralkali cell liquor in the anode compartment, through the diffusion barrier, and into the catholyte flowing in the cathode compartment.

FIG. 7 shows the inter-relationship between chloralkali cells and three-compartment hybrid cells used to treat the cell liquor from the chloralkali cells in accordance with this invention. Brine is introduced to the chloralkali cell 142 by line 144. Chlorine is generated at anode 146 and hydrogen released to cathode 148. Diaphragm 150 separates the compartments. Hydrogen generated in the chloralkali cell is supplied to anode 150 of cell 6 and cell liquor fed to anode compartment 154 by line 156. Air is supplied to gas diffusion cathode 158 and water to central compartment 160. Catholyte is drawn from compartment 162 by line 164. Line 166 connects the central compartment with the cathode compartment. The diffusion barrier or membrane is shown as 168 and the diaphragm as 170. With current flow as induced by reduction of oxygen at the cathode and oxidation of the hydrogen at the anode, sodium ions pass through the diffusion barrier and into the catholyte flowing in the central compartment. Sodium ions enter the cathode compartment as part of the aqueous medium flowing from the central compartment to the cathode compartment and by passage through the diaphragm.

In either FIG. 4 or FIG. 7, hydroxyl ions generated as a consequence of reduction of oxygen at the cathode combine with the transferred sodium ions to form sodium hydroxide. Consumption of water by generation of hydroxyl ions also serves to concentrate the sodium hydroxide solution being formed in the cathode compartment. Additional concentration occurs by evaporation of water through the cathode into air passing over the surface of the cathode opposite to the surface in contact with the catholyte. This water evaporation also serves to cool the hybrid cell.

The hybrid cells are in series with the chloralkali cell and produce a fraction of the power consumed by the chloralkali cell. Thus, while additional electric current from an outside source is required to operate the chloralkali cell and is shown as "power supply", the external energy required to operate the chloralkali cell is reduced.

In a typical operation of the two-compartment hybrid cell, a cell liquor containing about 12 percent by weight NaOH and 15 percent by weight NaCl is supplied to anode compartment 50. Water preferably containing some product alkali hyroxide to enhance conductivity is introduced to cathode compartment 54. In a three-compartment hybrid cell, the cell liquor is supplied to anode compartment 154 and water, again preferably alkali hydroxide enriched, is introduced to central compartment 160. Independent of the type of cell employed, the finished products withdrawn from the cascade may be an approximately 15 to 22 percent by weight NaCl solution containing a small amount of NaOH from the appropriate anode compartment and a purified, substantially chloride-free 50 percent by weight NaOH solution from the appropriate cathode compartment.

Although the present invention has been described with reference to particular details and embodiments thereof, these details are intended to illustrate the invention, the scope of which is defined in the following claims.

I claim:

1. A process for the production of alkali metal hydroxide and electrical energy by operating a plurality of three compartment hybrid cells in series, the plurality including a first hybrid cell at one end of the series and a last hybrid cell at the opposite end of the series, each hybrid cell comprising a gas diffusion anode having first and second surfaces, a diffusion barrier selectively permeable to cations and having first and second surfaces, a diaphragm permeable to both anions and cations and having first and second surfaces, and a gas diffusion cathode having first and second surfaces, the first surface of the anode and the first surface of the diffusion barrier defining an anode compartment, the second surface of the diffusion barrier and the first surface of the diaphragm defining a central compartment, and the first surface of the cathode and the second surface of the diaphragm defining a cathode compartment, the process comprising;

(a) introducing flow of an aqueous solution of at least one alkali metal hydroxide as anolyte to the anode compartment of said first hybrid cell at one end of the series;

(b) introducing flow of an aqueous fluid medium receptive to alkali metal ions as catholyte to the central compartment of said last hybrid cell at the opposite end of the series;

(c) causing the anolyte to flow through the anode compartment in sequence from the first hybrid cell to the last hybrid cell of the series;

(d) causing the catholyte to flow from the central compartment to the cathode compartment in each hybrid cell;

(e) causing the catholyte to flow from the cathode compartment of one hybrid cell to the central compartment of another hybrid cell in sequence from the last hybrid cell to the first hybrid cell of the series, the flow of catholyte in each central compartment being cocurrent with the flow of anolyte in the same hybrid cell and the flow of catholyte in the cathode compartment being countercurrent with respect to anolyte flow in the same hybrid cell;

(f) causing, in each cell by a flow of current through an external load between the cathode and the anode, which current is generated by oxidation of hydrogen supplied to the second surface of the gas diffusion anode and generation of hydroxide ions by reduction of an oxygen-containing gas supplied to the second surface of the gas diffusion cathode, alkali metal ions to selectively pass from the anolyte through the diffusion barriers to the catholyte to form with cathode generated hydroxide ions an aqueous solution of alkali metal hydroxide;

(g) withdrawing catholyte, which is more concentrated in respect to alkali metal hydroxide than the aqueous fluid medium introduced to the central compartment of the last hybrid cell of the series, from the cathode compartment of the first hybrid cell of the series; and (h) withdrawing anolyte, which is more depleted in respect to alkali metal hydroxide than the aqueous solution introduced to the anode compartment of the first hybrid cell of the series, from the anode compartment of the last hybrid cell of the series.

2. A process as claimed in claim 1 in which the alkali metal hydroxide comprises sodium hydroxide.

3. A process as claimed in claim 2 in which the sodium hydroxide content of the catholyte withdrawn from the cathode compartment of said first hybrid cell comprises up to about 40 percent by weight of the catholyte.

4. A process as claimed in claim 3 in which the anolyte comprises an aqueous effluent of a cathode compartment of a chloralkali cell comprising sodium hydroxide and sodium chloride.

5. A process as claimed in claim 1 in which said aqueous effluent of the cathode compartment of the chloralkali cell comprises up to about 25 weight percent sodium hydroxide and up to about 26 weight percent sodium chloride.

6. A process as claimed in claims 4 or 5 in which aqueous effluent of the cathode compartment of the chloralkali cell comprises up to about 25 weight percent sodium hydroxide and up to about 15 weight percent sodium chloride.

7. A process as claimed in claim 6 in which the solution withdrawn from said anode compartment contains alkali metal hydroxide in a concentration above about 0.1 percent by weight.

8. A process as claimed in claim 7 in which said anolyte withdrawn from the anode compartment of said last hybrid cell of the series contains alkali hydroxide in a concentration above about 0.5 percent by weight.

9. A process as claimed in claim 8 in which the alkali metal hydroxide is sodium hydroxide.

10. A process as claimed in claim 1 in which the flow of anolyte through the anode compartments, and the flow of the catholyte through the cathode compartments, are respectively substantially in one direction without appreciable mixing or back-convection of diffusion of molecules and ions comprising said anolyte or catholyte.

11. A process as claimed in claim 1 in which a condition of plug flow is maintained in the anode and cathode compartments.

12. A process as claimed in claim 1 in which the oxygen-containing gas comprises air.

13. A process as claimed in claim 1 in which the hydrogen supplied to the anodes is hydrogen generated by a chloralkali cell.

14. A process as claimed in claim 1 in which the flow of anolyte is ascending.

15. A process as claimed in claim 1 in which the flow of anolyte is descending.

16. A process as claimed in claim 1 in which catholyte from a hybrid cell of the series other than the last cell is introduced to the aqueous fluid medium introduced as catholyte to the last hybrid cell of the series to increase the conductivity of the aqueous fluid medium feed as catholyte to the last hybrid cell of the series.

* * * * *